United States Patent [19]

Smith, Jr.

[11] Patent Number: 4,815,160

[45] Date of Patent: Mar. 28, 1989

[54] PORTABLE CLEANING CONTAINER

[76] Inventor: Don A. Smith, Jr., 811 Mockingbird La., Norman, Okla. 73071

[21] Appl. No.: 116,385

[22] Filed: Nov. 3, 1987

[51] Int. Cl.[4] ..... A47L 13/50

[52] U.S. Cl. ..... 15/264; 210/248; 222/189

[58] Field of Search ..... 15/260–264; 210/241, 248, 163, 455; 222/189

[56] References Cited

U.S. PATENT DOCUMENTS

| | | | |
|---|---|---|---|
| 1,327,708 | 1/1920 | Guy | 222/189 |
| 1,441,675 | 1/1923 | Garvey | 222/189 |
| 1,767,840 | 6/1930 | Finnell | 15/264 |
| 3,747,154 | 7/1973 | O'Neil | 15/264 |
| 4,135,269 | 1/1979 | Marston | 15/4 |
| 4,295,244 | 10/1981 | Herpers et al. | 15/320 |
| 4,713,859 | 12/1987 | Smith, Jr. | 15/264 |
| 4,716,619 | 1/1988 | Young | 15/264 |

*Primary Examiner*—Harvey C. Hornsby
*Assistant Examiner*—Corinne M. Reinckens

[57] ABSTRACT

A portable cleaning container for use with a conventional mop and wringer for cleaning floors and other surfaces. The container includes a bucket with a drain opening formed through the bucket floor and closable by an elastomeric stopper supported on the end of a threaded drive rod extending through a threaded bore formed through a drive rod mount attached to the inside of the bucket within a stopper drive recess formed in the wall of the bucket and extending vertically from the floor of the bucket above the drain opening. A filter recess is formed in portions of the upper surface of the bucket floor to receive an interior filter having a planar portion that extends across the filter recess and a semi-tubular portion that extends about lower portions of the stopper drive recess to enclose the entrance of the drain opening to the bucket interior. Troughs in the planar portion of the interior filter and corrugations in the floor of the bucket adjacent the filter recess trap detritus when the bucket is drained. A pivoting external filter is mounted on the underside of the bucket floor for movement between a position underlaying the drain opening and a position to one side of the bucket.

17 Claims, 4 Drawing Sheets

PORTABLE CLEANING CONTAINER

CROSS REFERENCE TO COPENDING APPLICATION

The subject matter of the present invention is related to the subject matter disclosed in the Applicant's copending U.S. patent application, Ser. No. 904,164, entitled, "PORTABLE CLEANING CONTAINER", (as amended), filed Sept. 5, 1986.

BACKGROUND OF THE INVENTION

1. Field of the Invention.

The present invention relates generally to the field of containers and, more particularly, but not by way of limitation, to portable bucket-like containers for use in cleaning of floors.

2. Brief Description of the Prior Art.

As has been discussed in my copending U.S. patent application, Ser. No. 904,146, entitled, "PORTABLE CLEANING CONTAINER", filed Sept. 5, 1986, the teachings of which are hereby incorporated by reference, the use of bucket-like containers in the mopping or cleaning of floors has long been practiced and such containers have been designed specifically for these purposes by providing the containers with wheels to facilitate movement about a floor. In use, containers used for this purpose contain a cleaning solution in which a mop can be immersed for transfer of the solution to a floor; and it is also known to provide such a container with a wringer to remove excess cleaning solution from the mop. Such wringers are mounted on the container during cleaning operations and are operable by a handle to squeeze the mop between a wall of the wringer and a movable plate. For convenience of use, the movable plate is spring biased away from such wall of the wringer and the wringer comprises a mechanical linkage between the plate and the handle that extends the handle longitudinally of the wringer body at such times that the plate is displaced from such wall so that the handle extends generally vertically from the container upon which the wringer is mounted.

Prior to the invention of the portable cleaning container disclosed in my above-referenced United States Patent Application, a number of problems existed with prior art containers used in the cleaning of floors or the like. In particular, mop strings and other detritus in the cleaning solution can clog a drain into which a container is emptied after a cleaning operation so that the blockage must be cleared by hand. Such clearing is an unpleasant task made even more unpleasant by the caustic nature of many cleaning compounds, especially compounds used in commercial settings. Additionally, prior to such invention, removal of detritus from a cleaning container was often a difficult procedure involving lifting of the cleaning container while a water spray was directed into the interior thereof. The cleaning container disclosed in my copending U.S. patent application, Ser. No. 904,164, provided a major advance in overcoming these problems by providing a cleaning container that could be drained through an external filter via an integral valve positioned exteriorly of the container. The external filter of this cleaning container catches detritus within the filter and cleaning of the filter can be accomplished with no lifting of the container.

However, some problems were not addressed and other problems not completely solved by the cleaning container disclosed in my above-referenced U.S. patent application. In particular, some difficulties have been experienced with the container drainage and filtering systems of the cleaning container disclosed in my copending application in circumstances in which large amounts of detritus are contained in the cleaning container after use. In these circumstances, the detritus can clog the valve with which this cleaning container is provided and, additionally, the filter of such container can become overloaded so that detritus spills about the filter to enter a drain. Moreover, the cleaning container disclosed in my copending application did not address problems that arise in the storage of the cleaning container between mopping operations nor problems associated with shipping cleaning containers from the point of manufacture to commercial outlets.

SUMMARY OF THE INVENTION

The present invention eliminates problems that have arisen in the circumstances described above and, additionally, solves storage and shipping problems that have not previously been addressed. To these ends and in one aspect of the present invention, the cleaning container of the present invention is provided with a valve assembly that is located wholly within the container, or bucket, and is constructed such that the operating mechanism of the valve cannot be jammed by detritus within the bucket. Specifically, the cleaning container is provided with a drain opening in lowermost portions of a bucket, and the cleaning container is further provided with a valve assembly comprised of an elastomeric stopper positioned interiorly of the bucket above the drain opening and a stopper drive assembly that can be utilized to move the stopper into the drain opening or away therefrom. In a second aspect of the invention, a removable internal filter capable of retaining large pieces of material in the bucket is positioned about the drain opening to insure that any detritus large enough to clog the drain opening will be retained within the bucket atop the internal filter so that such detritus can be disposed of by removing the internal filter from the bucket and discharging detritus thereon to a suitable waste receptacle. Thus, the cleaning container of the present invention eliminates problems that have been encountered in the past even in extreme circumstances that might arise in the cleaning of a floor or other surface. Additionally, the construction of the cleaning container of the present invention facilitates the elimination of storage and shipping problems that have occurred in the past in a manner that will be discussed below.

An object of the present invention is to provide an improved cleaning container for holding cleaning solutions used in cleaning operations and which minimizes the necessity of a person handling or otherwise being contacted by the contents thereof.

Another object of the invention is to provide an improved cleaning container that eliminates the discharge of detritus mingled with cleaning solution from the container to a drain following use of the container.

A further object of the invention is to provide a cleaning container that can be easily cleansed following use to remove contaminants prior to storage.

Yet another object of the invention is to provide a cleaning container that achieves the above objects even under extreme circumstance of use of the container in which large amounts of detritus are introduced thereinto.

Still another object of the invention is to facilitate the storage of a cleaning container when not in use.

Another object of the invention is to facilitate the shipment of cleaning containers from a point of manufacture to a commercial outlet.

Other objects, advantages and features of the present invention will become clear from the following detailed description when read in conjunction with the drawings and the appended claims.

DESCRIPTION OF THE PREFERRED EMBODIMENT

Figure 1:
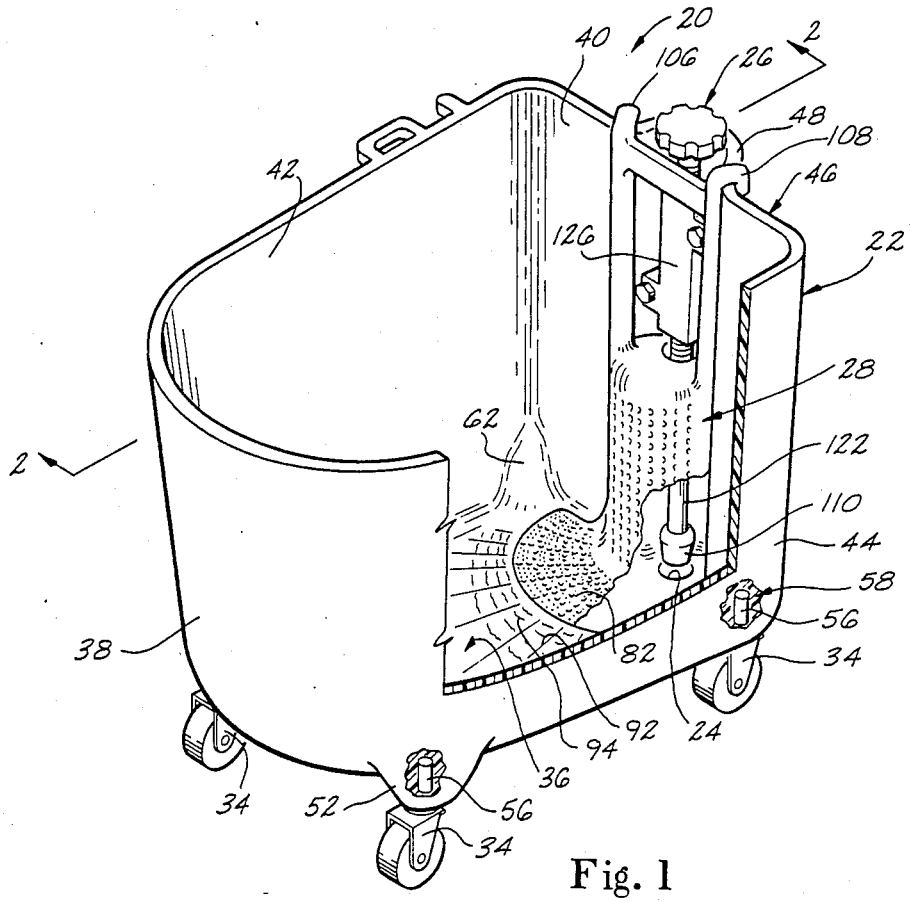
FIG. 1 is an isometric view in partial cutaway of a cleaning container constructed in accordance with the present invention.
Figure 2:
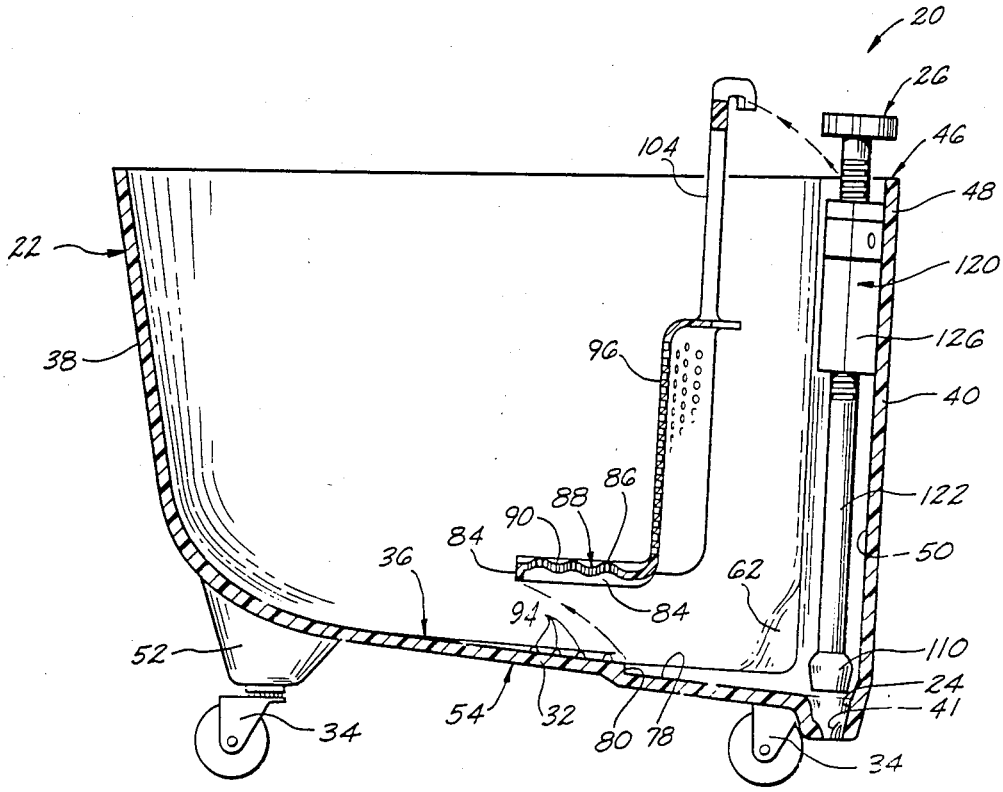
FIG. 2 is a cross-section of the cleaning container taken along line 2—2 of FIG. 1.

Referring now to the drawings in general, and to FIGS. 1 and 2 in particular, shown therein and designated by the general reference numeral 20 is a cleaning container constructed in accordance with the present invention. As illustrated, the cleaning container 20 is generally comprised of: a bucket 22 for containing a cleaning solution and having a drain opening 24 formed through lowermost portions thereof; an internally mounted valve assembly 26 for closing the drain opening 24 of the bucket 22 during use of the cleaning container 20; an internal filter assembly 28; and an external filter assembly 30. (The external filter assembly 30 has been illustrated in FIGS. 5 and 6).

Referring first to the bucket 22, the bucket 22 is preferably of unitary construction provided by molding the bucket of a suitable composition material and is generally comprised of a bottom portion 32 supported by casters 34 to form an angularly disposed floor 36 for the interior of the bucket 22, and a wall portion (not numerically designated in the drawings) comprised of end walls 38 and 40, respectively, and side walls 42 and 44, respectively. As illustrated, the walls 38–44 extend downwardly from an upper edge 46 of the bucket 22 and are canted with respect to the vertical so that the wall portions of the bucket 22 generally converge toward the bottom portion 32; and the wall 38, also referred to herein as a rearward wall 38, can be arctuately curved to facilitate attachment of a wringer of conventional construction to the rearward wall 38, as well as to facilitate shipping of cleaning containers 20 as will be discussed below. As has been shown, the floor 36 generally slopes downwardly from the rearward wall 38 toward the wall 40, also referred to herein as a forward wall 40, and the drain opening 24 is formed through the bottom portion 32 of the bucket 22 adjacent the forward wall 40, and centrally disposed thereof, so that the drain opening 24 is located at the lowermost end of the floor 36.

As shown in FIG. 2, in the lower portion of the drain opening 24 is provided with a plurality of baffle members, such as baffle member 41. The baffle members cooperate to impede horizontal movement of the cleaning solution as it is discharged from the bucket 22 via the drain opening 24.

In accordance with the invention, a portion 48 of the forward wall 40 is arched outwardly from the interior of the bucket 22 to form a stopper drive recess 50 in the forward wall 40 of the bucket 22, the arching portion 48 being centrally disposed in the forward wall 40 so that the recess 50 extends upwardly from the drain opening 24 for a purpose to be described below.

Figure 10:
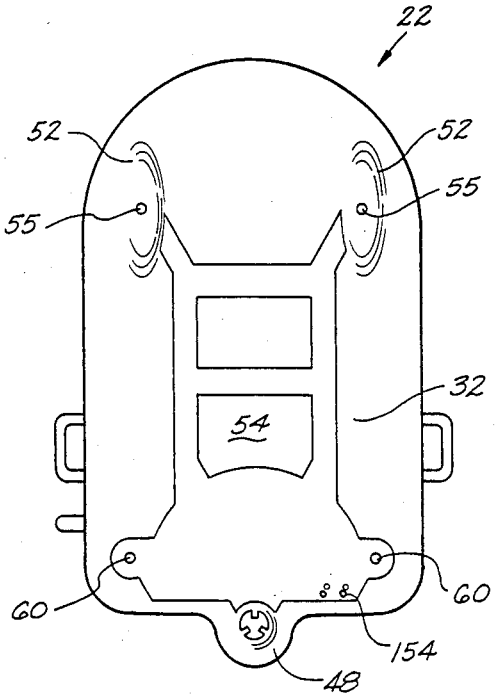
FIG. 10 is a bottom view of the bucket of the cleaning container.

To provide for the mounting of the casters 34, hollow projections 52 are molded onto the bucket 22 to extend from the underside 54 of the bottom portion 32 of the bucket 22 from a position near the rearward wall 38 and openings 55 (FIG. 10) are formed through the ends of the projections 52 distal from the bottom portion 32 to receive tangs 56 of two of the casters 34. Chambers 58 (only one chamber 58 has been illustrated in the drawings), formed in the side walls 42, 44 during the bucket molding process, are located at the junctures of each of the side walls 42, 44 with the bottom portion 32 of the bucket 22 and with the forward wall 40 to similarly receive tangs 56 of an additional two casters 34 via holes 60 (FIG. 10) formed through portions of the bottom portion 32 overlain by the chambers 58.

Figure 9:
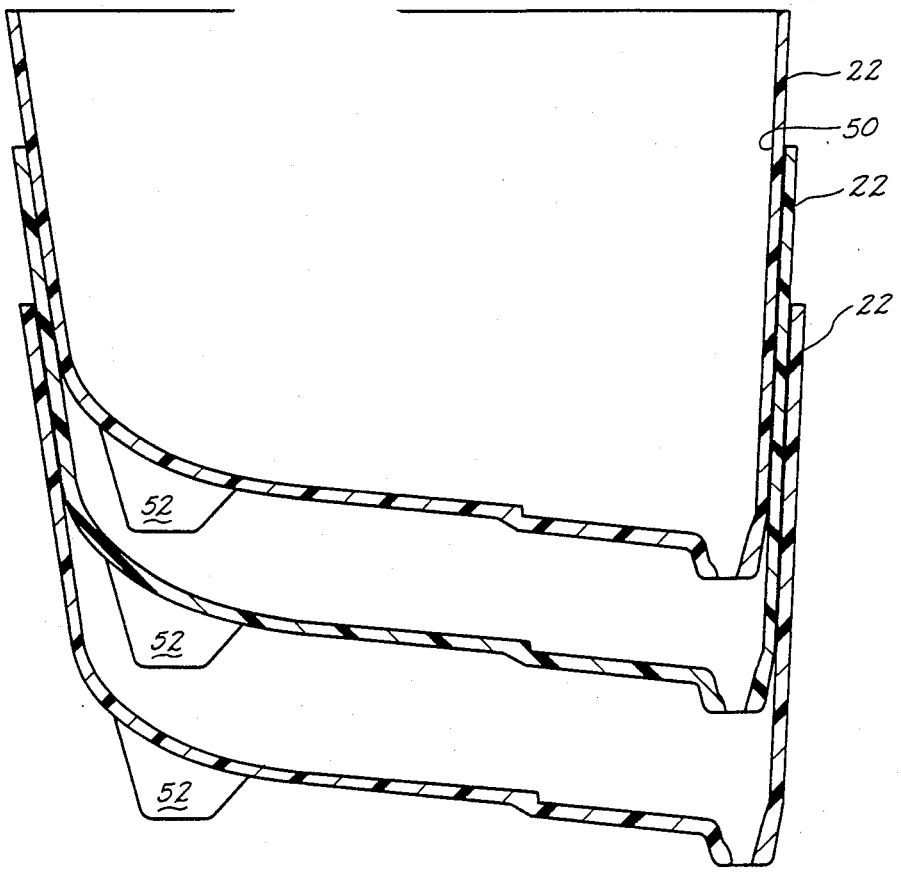
FIG. 9 is a longitudinal cross-section of a plurality of cleaning containers positioned in a shipping mode.

As can be seen in FIGS. 1 and 2 for the side wall 42, portions 62 of the side walls are extended into the interior of the bucket 22 to enclose the chambers 58 and thereby maintain the structural integrity of the bottom portion 32 against leakage which might otherwise occur about the tangs 56 of the casters 34 in the chambers 58. The extension of the portions 62 of the side walls 42, 44 into the interior of the bucket 22 and the positioning of the projections 52 from the underside 54 of the bottom portion 32 thus does not interrupt the convergence of the wall portion of the bucket 22 toward the bottom portion 32 thereof so that a plurality of buckets 22 can be nested for shipping, as illustrated in FIG. 9, by removal of the casters 34 from the bucket 22. Such nesting is facilitated by the curvature of the rearward wall 38 that has been noted above.

Figure 7:
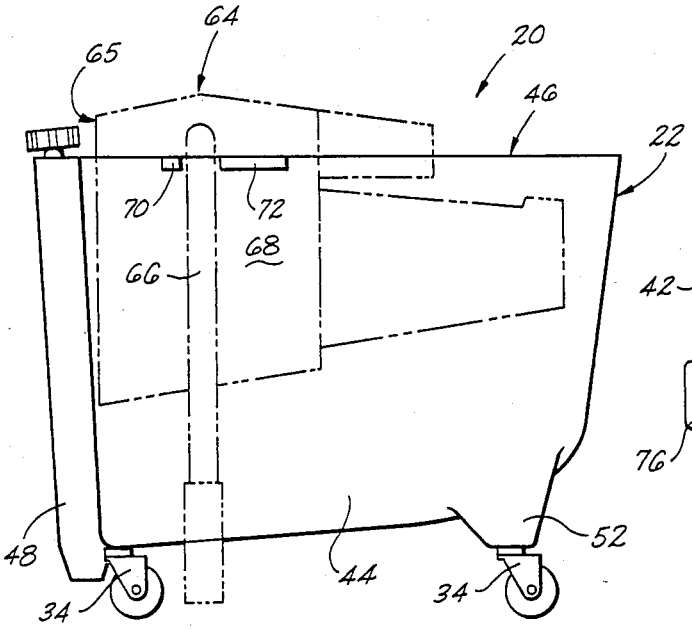
FIG. 7 is a side view of the cleaning container illustrating the positioning thereon for storage of a wringer device.
Figure 11:
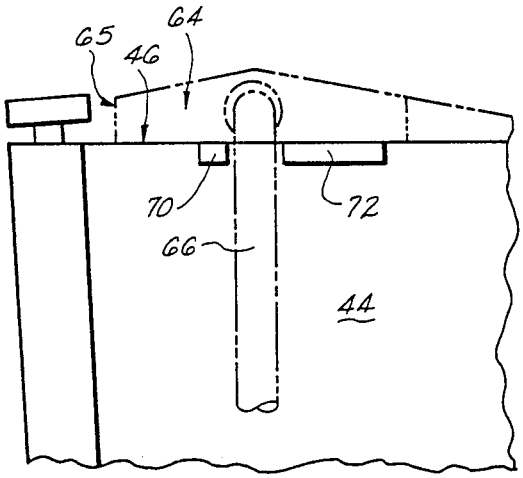
FIG. 11 is a fragmentary side view on an enlarged scale of the bucket and wringer device.

Similarly, the bucket 22 is provided with features that facilitate storage of the cleaning container 20 when the container is not in use. As has been noted above, it is common practice to use a conventional wringer 64, indicated in phantom lines of FIGS. 7, 8 and 11, with the cleaning container 20, and at such times that the container is in use, the wringer 64 is mounted on the rear wall 38 of the bucket 22 in a known manner. The wringer 64 has a handle 66 that is spring biased to extend longitudinally of the wringer body 68; that is, vertically, when the cleaning container 20 is in use to facilitate operation of the wringer by moving the handle 66 in a vertical arc. Such wringers and their use are well known so that the wringer 64 per se need not be further discussed herein.

Figure 8:
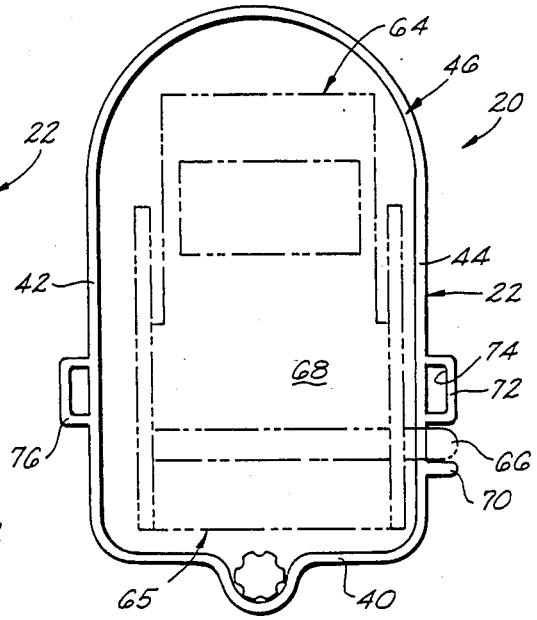
FIG. 8 is a top view of the cleaning container illustrating the positioning therein for storage of the wringer device.
Figure 1B:
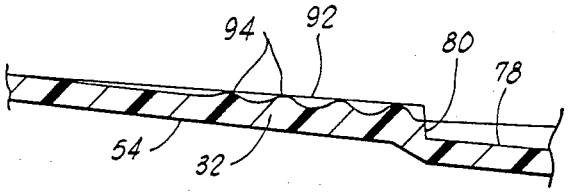
FIG. 1B is a fragmental, cross-sectional view of the bottom of the cleaning container illustrating the corrugations therein.
Figure 1A:
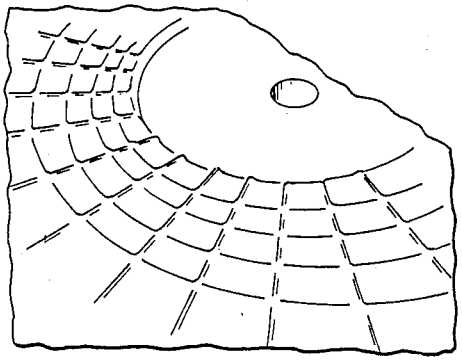
FIG. 1A is a fragmental, isometric view of a bottom of the cleaning container of FIG. 1 illustrating corrugations therein.

The construction and mounting of the wringer 64 described above results in the cleaning container-wringer combination being a bulky object that is unsuited for storage when the wringer is mounted on the cleaning container for use of the combination. The present invention contemplates that storage will be facilitated by placing the wringer 64 within the bucket 22 for storage as has been particularly illustrated in FIGS. 7 and 8. However, in such position of the wringer 64, the top 65 thereof will be adjacent the forward wall 40 so that the spring biasing of the handle 66 will result in the handle protruding from the forward wall 40. Such protrusion, which would interfere with storage of the cleaning container-wringer combination, is prevented in the present invention by providing the bucket 22 with a pair of spaced apart, laterally extending projections 70 and 72 that are formed on the wall adjacent the upper edge 46 of the bucket 22 near the forward wall 40 so that, when the wringer 64 is placed in the bucket 22, the handle 66 thereof can be moved downwardly to the position shown in the drawings and captured between the projections 70 and 72 to form the cleaning container - wringer combination into a compact unit for storage. As shown in FIG. 8, an opening 74 can be formed through the projection 72 and a similar projection 76 can be formed on the wall 42 adjacent the upper edge 46 of the bucket 22 and in lateral alignment with the projection 72 to form handles that facilitate movement and lifting of the cleaning container 20.

Returning now to FIG. 2, a filter recess 78 is formed in the floor 36 of the bucket 22 adjacent the forward wall 40, the recess 78 having a periphery 80 that curves in an arc about the entrance of the drain opening 24 into the bucket 22 so that the ends of the arc are disposed to opposite sides of the stopper drive recess 50. The filter recess 78 facilitates the positioning of the internal filter 28 in the bucket 22 so that the filter 28 can be quickly emplaced within the bucket 22 or removed therefrom in a manner illustrated in FIG. 2. It will be useful to describe the construction of the filter 28, with continuing reference to FIG. 2 and additional reference to FIG. 3, prior to discussing the mounting of the internal filter 28 on the bucket 22. However, as shown in the drawings, the internal filter 28 (which is a substantially planar member having an upper surface) is disposed within the filter recess 78 such that the substantially planar member of the filter 28 and the angularly disposed floor 36 of the bottom portion 32 are substantially contiguous, or in the alternative, the internal filter 28 is disposed slightly below the plane of the angularly disposed floor 36.

Figure 3:
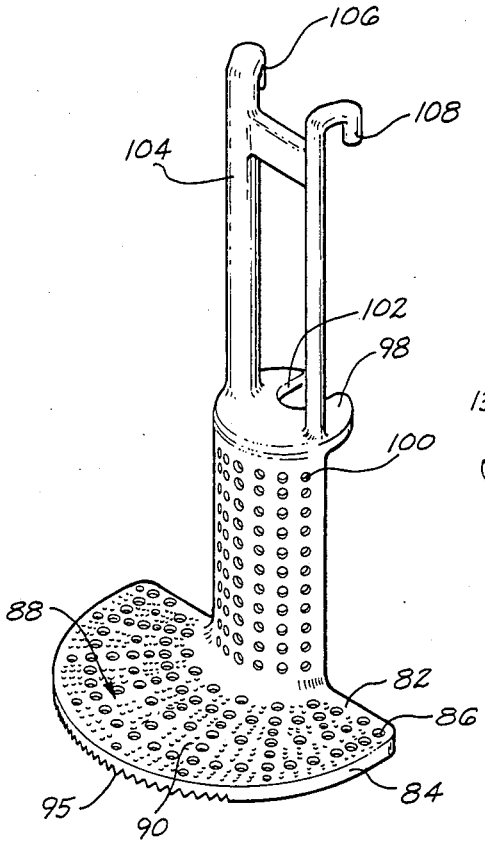
FIG. 3 is an isometric view of the internal filter of the cleaning container.

As shown in FIGS. 2 and 3, the internal filter 28 is comprised of a substantially planar, semicircular lower portion 82 having a downturned edge 84 that mates with the periphery 80 of the filter recess 78 and a plurality of perforations 86 are formed through the lower portion 82 of the internal filter 28 to permit passage of cleaning solution through the lower portion 82 while large pieces of detritus will be retained on the upper surface 88. Such retention is facilitated by forming a plurality of troughs 90 in the surface 88 between the perforations 86 to capture large sand grains, gravel and the like. In keeping with this purpose of the troughs 90, corrugations 92 (see FIG. 1) and 94 are formed in the floor of the bucket 22 adjacent the filter recess 78, the corrugations 92 extending generally radially from the drain opening 24 and the corrugations 94 extending generally arcuately about the drain opening 24.

To further insure that solution in the bucket 22 can be effectively drained therefrom when the internal filter 28 is disposed within the filter recess 78, the downturned edge 84 of the lower portion 82 of the internal filter 28 is serrated (as designated by the numeral 95 in FIG. 3). The serrations thus permit fluid flow between the bottom portion 32 of the bucket 22 to the filter recess 78 via the serrated portion 95. It should be noted that the distance between the downturned edge 84 of the internal filter 28 and the periphery 80 of the filter recess 78 is such that large sized detritus is prevented from passing therebetween, although solution can readily pass therebetween for disposal via the drain opening 24 when same is in the open position.

Returning to FIGS. 2 and 3, the internal filter 28 is further comprised of a semitubular medial portion 96 that extends upwardly from portions of the lower portion 82 centered with respect to the curving edge 84, and the medial portion 96 is dimensioned to extend arcuately about lower portions of the stopper drive recess 50 as illustrated in FIG. 1. The medial portion 96 is capped with a generally circular lamina 98 that fits within the stopper drive recess 50 so that the lower and medial portions of the internal filter 28 form an enclosure for the entrance of the drain opening 24 into the floor 36 of the bucket 22 as has also been illustrated in FIG. 1. A plurality of perforations 100 is formed through the medial portion 96 of the filter 28 to permit passage of cleaning solution therethrough and a notch 102 is formed in portions of the lamina 98 within the stopper drive recess 50 for a purpose to be discussed below.

Extending upwardly from the medial portion 96, the internal filter 28 is further comprised of a handle portion 104 having hooks 106 and 108 at the upper end thereof that extend over the edge 46 of the bucket 22 to either side of the stopper drive recess 50 formed by the outwardly arching portion 48 of the bucket wall portion as illustrated in FIG. 1. A convenient manner of constructing the handle portion 104 to provide the hooks 106 and 108 has been illustrated in the drawings wherein the handle portion is shown to comprise two rods (not numerically designated) extending from the top of the medial portion 96 and having downturned portions forming the hooks 106 and 108.

Figure 4:
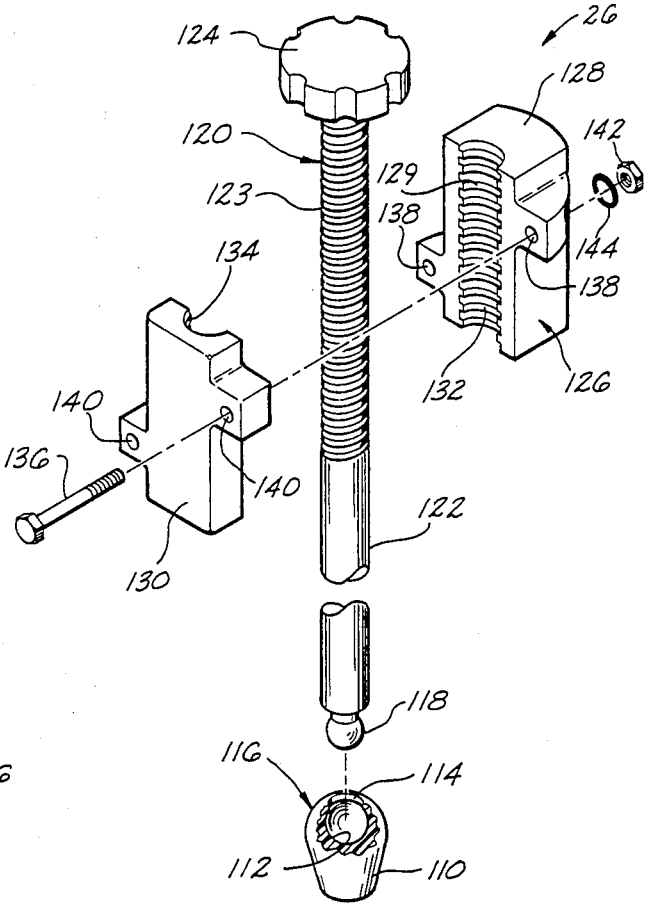
FIG. 4 is an exploded isometric view in partial cutaway of the valve assembly of the cleaning container.

Coming now to the valve assembly 26, such assembly has been particularly illustrated in FIGS. 2 and 4 to which attention is now invited. As shown in these Figures, the valve assembly 26 is comprised of an elastomeric stopper 110 having a spherical cavity 112 formed in upper portions thereof. An opening 114 is formed in the stopper 110 to extend between the cavity 112 and the upper surface 116 of the stopper 110 so that a ball 118 forming a part of a stopper drive assembly generally designated as 120 in FIGS. 2 and 4 can be inserted into the cavity 112. The diameter of the ball 118 is substantially the same as the diameter of the cavity 112 so that the ball 118 will mate with the cavity 112 and the opening 114 is formed on a reduced diameter so that, once the ball 118 has been forced into the cavity 112 of the stopper 110, the stopper 110 will be retained thereon.

The ball 118 is formed on the lower end of a drive rod 122 having square threads 123 formed on an upper portion thereof and the drive rod 122 is capped with a knob 124 that permits the drive rod 122 to be easily grasped. In addition to the drive rod 122, the stopper drive assembly 120 is further comprised of a drive rod guide 126 formed in two portion 128 and 130 that can be bolted together about the threaded portions of the drive rod 122. Semicircular grooves 132 and 134 are formed in mating sides of the rod guide portions 128 and 130, respectively, to form a bore (not numerically designated in the drawings) when the portions 128 and 130 are mated and the grooves are provided with square threads, such as square threads 129 in the portion 128, while in an assembled position, to mate with the threads 123 of the drive rod 122.

As indicated in FIG. 3, the portion 128 of the drive rod guide 126 has a cylindrical surface formed on the side thereof remote from the portion 130 and such surface is formed concentrically with the bore formed through the drive rod guide to mate with the stopper drive recess 50 as shown in FIG. 2. The valve assembly 26 is secured within the recess 50 via bolts 136 that pass through holes 138 and 140 formed through the portions 128 and 130 respectively to opposite sides of the bore formed through the drive rod guide 126 and through holes (not shown) formed through the wall portion of the bucket 22 to nuts 142 screwed on the bolts 136 outside the bucket 22. (Only one bolt 136 and nut 142 have been illustrated in the drawings). A sealing ring 144 can be mounted on each of the bolts to prevent leakage of the bucket 22 about the bolts 136. The mounting of the valve assembly 26 on the bucket 22 is in keeping with the object of providing the cleaning container 20 with a facility for shipping. In particular, during shipping, the valve assembly 26 is removed from the bucket 22 to permit the nesting of a plurality of buckets in the manner illustrated in FIG. 9.

The thickness of the portion 128 of the drive rod guide 126, coupled with the mounting of the valve assembly 26 within the stopper drive recess 50, positions the drive rod 122 to pass through the notch 102 and extend toward the drain opening 24 (as shown in FIG. 2) so that the drain opening 24 can be closed by turning the knob 124 in a direction that will cause the drive rod 122 to advance toward the drain opening 24 and to insert the stopper 110 into the drain opening 24. Alternatively, the knob 124 can be turned in the opposite direction to withdraw the stopper from the drain opening 24 and thereby permit the draining of cleaning solution from the bucket 22.

Figure 5:
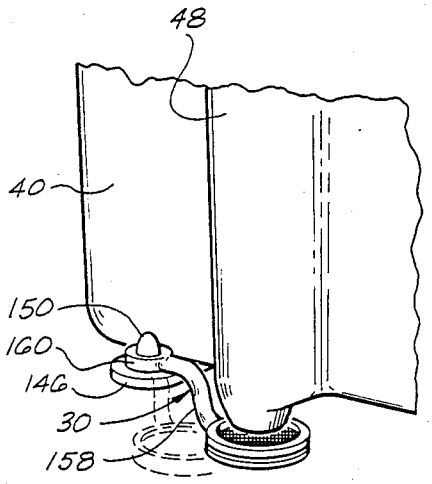
FIG. 5 is a fragmentary view of one end of the cleaning container illustrating the external filter assembly thereof.
Figure 6:
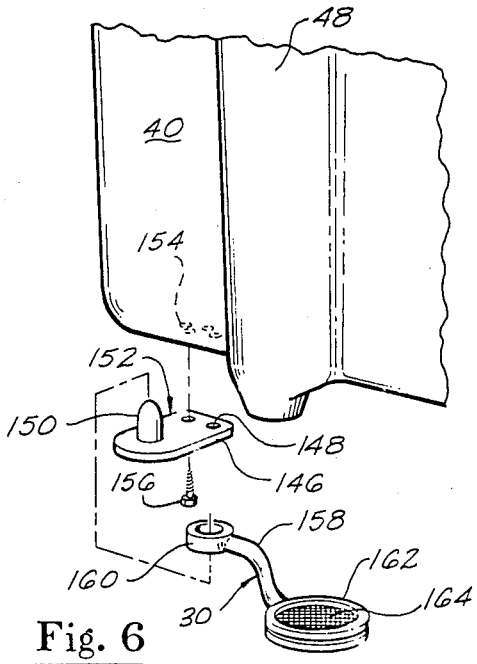
FIG. 6 is an exploded view of the external filter assembly.

Referring now to FIGS. 5 and 6, the external filter assembly 30 is comprised of a mounting plate 146 having a pair of holes 148 formed therethrough near one end of the plate 146 and having a circular projection attached to the upper side 152 thereof near the opposite end of the plate 146. Four holes 154, arranged in two pairs positioned in correspondence, are formed in the underside of the bucket 22 so that the mounting plate 146 can be attached to the underside of the bucket 22 via self tapping screws 156 (only one screw 156 has been illustrated) that extend through the holes 148 and into one pair of the holes 154. The projection 150 is positioned on the mounting plate 146 so that the projection will be located laterally of the bucket 22 as shown in FIG. 5; and the projection 150 is utilized to pivotally mount a filter support arm 158 on the bucket 22.

The filter support arm 158 is provided with a ring 160 on one end thereof that fits over the projection 150 formed on one end for this purpose as shown in FIGS. 5 and 6. Preferably, and as shown, the projection 150 has a "bullet" shape for ease of positioning of the ring 160 thereon. A second ring 162 is formed on the opposite end of the filter support arm 158 and contains a piece of wire mesh 164 forming an external filter for the cleaning container 20.

The support arm 158 is also provided with an S-shaped curve that permits positioning of the wire mesh 168 beneath the drain opening 24 formed at the bottom of the arched portion 48 of the bucket wall portion as shown in FIG. 5 Alternatively, the filter support arm 158 can be pivoted to extend the external filter laterally of the bucket 22 or removed for cleaning the external filter. As in the case of the casters and valve assembly, the external filter assembly 30 is removed during shipping of cleaning containers constructed in accordance with the present invention.

In order to provide a clear understanding of the invention, a brief description of the use of the cleaning container 20 will hereinafter be set forth. At such times that the cleaning container 20 is in use to clean a floor or like surface, the drive rod 122 will have been positioned, by turning the knob 124, to insert the stopper 110 in the drain opening 24 so that a cleaning solution can be introduced into the bucket 22 and the wringer 64 will have been mounted on the rear wall 38 of the bucket 22 in a conventional manner. During floor cleaning, a mop will be periodically inserted into the cleaning solution to discharge detritus into the bucket 22; and excess solution will be removed from the mop by inserting the mop into the wringer 64 and moving the handle 66 thereof in a conventional manner. During this operation, the internal filter 28 will be in place about the drain opening 24, the stopper 110 and the lower portion of the drive rod 122 so that any large pieces of detritus, such as large sand, gravel, mop strings and paper will be maintained away from the drain opening 24. The external filter will be positioned under the drain opening 24 so that the external filter assembly 30 will be in a protected position should the forward wall 40 of the bucket inadvertantly strike an object that might damage the external filter assembly 30.

At the conclusion of mopping operations, the cleaning container 20 is positioned such that the drain opening 24 is above a floor drain. The knob 124 is then turned in a direction to lift the drive rod 122 and lift the stopper 110 from the drain opening 24 so that the cleaning solution will be discharged from the bucket 22. However, large pieces of detritus will be lodged atop the internal filter 28 while smaller pieces will be caught in troughs formed in the upper surface of the lower portion of the internal filter 28 or passed through the perforations 86 to be caught by the external filter formed by the mesh 164. During draining of the bucket 22, the corrugations 92 and 94 in the floor 36 of the bucket 22 will slow the flow of cleaning solution across the bucket floor 36 so that much of the small pieces of detritus will be captured by the corrugations and troughs so that little detritus of a size capable of clogging the floor drain will reach the external filter. Such detritus will be captured by the external filter so that no clogging of the floor drain will occur.

Following the draining of the bucket 22, any remaining liquid is removed from the mop by the action of the wringer 64, and the wringer 64 is removed from the bucket 22. Thereafter, the internal filter 28 can be lifted from the bucket 22 (as illustrated in FIG. 2) so that detritus thereon can be dislodged into a suitable waste receptacle. The external filter will similarly be lifted from the mounting plate 146 for similar disposal of detritus thereon. The two filters can then be returned to the interior of the bucket 22 and the mounting plate 146 and the bucket is then flushed with water to force any detritus remaining in the bucket 22 onto the two filters for a second removal and dislodgement of detritus into a waste receptacle. A final rinse of the two filters then completes the cleaning of the cleaning container 20 for storage.

Following the cleansing of the cleaning container 20, the handle 66 of the wringer 64 is turned against the spring biasing thereof to extend laterally from the wringer body 68 and the wringer 64 is lowered into the bucket 22 such that the handle 66 extends between the projections 70 and 72 on the wall 44 of the bucket 22. In such condition of the wringer 64, the cleaning container-wringer combination form a compact unit which can be conveniently stored in any suitable storage area.

It will be clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. A portable cleaning container comprising:

a bucket for containing a cleaning solution, the bucket comprising a bottom portion and a wall portion, the bottom portion forming an angularly disposed floor having a drain opening and filter recess formed therein, the drain opening being formed through the bottom portion adjacent the lowermost end of the floor, the filter recess being formed in portions of the bucket floor adjacent the drain opening and extending thereabout, the wall portion extending upwardly from the floor about the interior of the bucket such that the wall portion is provided with an outwardly arcing portion adjacent the drain opening to form a stopper drive recess extending upwardly from the drain opening;

an elastomeric stopper disposed above the bucket drain opening;

stopper drive means supporting the stopper and for moving the stopper into and away from the drain opening, the stopper drive means comprising:

a drive rod guide mounted in the bucket above the drain opening and having a threaded bore formed therethrough coaxially with the drain opening; and a threaded drive rod mounted in the bore of the drive rod guide and extending therefrom toward the drain opening, the stopper being mounted on one end of the drive rod adjacent the drain opening such that the drive rod guide and drive rod are mounted within the stopper drive recess in the wall portion of the bucket; and an internal filter having a substantially planar, perforated lower portion disposable within the filter recess, the lower portion of the filter having a downturned edge to mate with the filter recess, the downturned edge of the internal filter being serrated and having troughs formed in the upper surface of the lower portion of the internal filter between perforations therethrough for capturing detritus at such times that the cleaning solution is drained from the bucket.

2. The cleaning container of claim 1 wherein a plurality of corrugations are formed in the bucket floor adjacent the filter recess, selected corrugations extending radially from the drain opening and selected corrugations extending arcuately about the drain opening.

3. The cleaning container of claim 1 wherein the internal filter further comprises a semitubular, perforated medial portion extending from the lower portion thereof toward the rod guide mount and extending across lower portions of the stopper drive recess in the end wall of the bucket.

4. The cleaning container of claim 3 wherein the internal filter further comprises a handle portion extending upwardly from the medial portion, the handle portion having hooks formed thereon to extend over the top of the wall portion of the bucket to either side of the stopper drive recess.

5. The cleaning container of claim 1 further comprising:

a filter support arm pivotally mounted on the underside of the bucket adjacent the drain opening; and an external filter mounted on the distal end of the external filter support arm, whereby the external filter can be moved between a position underlaying the drain opening and a position displaced laterally from the lowermost end of the bucket via pivotation of the external filter support arm.

6. A portable cleaning container comprising:

a bucket for containing a cleaning solution comprising a bottom portion forming an angularly disposed floor and a wall portion extending upwardly from the bottom portion to terminate in an upper edge of the bucket remote from the bottom portion, the bottom portion having a filter recess formed in lowermost portions of the floor and a drain opening formed in the filter recess;

an elastomeric stopper in the bucket above the drain opening;

stopper drive means supporting the stopper in the bucket for moving the stopper into and away from the drain opening;

a removable internal filter positionable within the filter recess to enclose the drain opening, stopper and portions of the stopper drive means adjacent the stopper, the internal filter comprising:

a lower portion disposable in the filter recess; and a handle portion extending along the wall portion and having hook means at the upper end thereof extending over the upper edge of the bucket.

7. The cleaning container of claim 6 wherein the lower portion of the internal filter in the filter recess is characterized as a substantially planar, perforated portion having a downturned edge to mate with the filter recess.

8. The cleaning container of claim 7 wherein troughs are formed in the upper surface of the lower portion of the internal filter between perforations therethrough for capturing detritus at such times that the cleaning solution is drained from the bucket.

9. The cleaning container of claim 8 wherein a plurality of corrugations are formed in portions of the bucket floor adjacent the filter recess, selected corrugations extending radially from the drain opening and selected corrugations extending arcuately about the drain opening.

10. The cleaning container of claim 6 further comprising:

a filter support arm pivotally mounted on the underside of the bucket adjacent the drain opening; and an external filter mounted on the distal end of the external filter support arm, whereby the external filter can be moved between a position underlaying the drain opening and a position displaced laterally from the lowermost end of the bucket via pivotation of the external filter support arm.

11. The cleaning container of claim 6 wherein the cleaning container further comprises a pair of spaced apart, laterally extending projections formed on the wall portion adjacent the upper edge of the bucket.

12. A portable cleaning container comprising:

a bucket for containing a cleaning solution, the bucket characterized as comprising a bottom portion forming an angularly disposed bucket floor having a filter recess formed in lowermost portion thereof and a drain opening formed through the bottom portion of the bucket within the filter recess;

valve means for closing the drain opening; and an internal filter supported within the filter recess, the interior filter having perforated portions enclosing the drain opening, the internal filter comprising:

a substantially planar perforated lower portion having an upper surface and a down-turned edge mating the recess, the upper surface thereof having troughs formed therein between the perforations for capturing detritus at such times that the cleaning solution is drained from the bucket.

13. The cleaning container of claim 12 wherein a plurality of corrugations are formed in the floor of the bucket adjacent the filter recess, selected corrugations extending radially from the drain opening and selected corrugations extending arcuately about the drain opening.

14. The cleaning container of claim 12 further comprising:

a filter support arm pivotally mounted on the underside of the bucket adjacent the drain opening; and an external filter mounted on the distal end of the external filter support arm, whereby the external filter can be moved between a position underlaying the drain opening and a position displaced laterally from the lowermost end of the bucket via pivotation of the external filter support arm.

15. The cleaning container of claim 12 further comprising baffle means projecting into a lower portion of the drain opening for impeding horizontal movement of cleaning solution discharged from the bucket via the drain opening.

16. A portable cleaning container comprising:

a bucket for containing a cleaning solution, the bucket characterized as comprising an angularly disposed bucket floor and a wall portion, the angularly disposed bucket floor having a filter recess and a drain opening formed in a lowermost portion thereof, the drain opening being disposed within the filter recess;

valve means for closing the drain opening; and an internal filter removably supported within the filter recess, the internal filter having perforated portions enclosing the drain opening, the internal filter comprising:

a substantially planar, perforated lower portion having an upper surface, the perforated lower portion removably positionable within the filter recess such that the upper surface thereof and the angularly disposed bucket floor form a substantially continuous surface when the filter is positioned within the recess.

17. A portable cleaning container comprising:

a bucket for containing a cleaning solution having a floor portion with a drain opening formed therethrough at its lowermost portion;

a stopper in the bucket above the bucket drain opening;

stopper drive means supporting the stopper in the bucket for moving the stopper into and away from the drain opening;

a filter recess formed in portions of the bucket floor adjacent the drain opening and extending thereabout within the interior of the bucket; and an internal filter disposed within said filter recess having a perforated lower portion substantially planar with the filter recess, the lower portion of the filter having a serrated down-turned edge to mate with the filter recess, within which troughs are formed in the upper surface of the lower portion of the internal filter between perforations therethrough for capturing detritus at such times that the cleaning solution is drained from the bucket.

* * * * *